US007681255B2

(12) United States Patent
Morales et al.

(10) Patent No.: US 7,681,255 B2
(45) Date of Patent: Mar. 23, 2010

(54) PANTS WITH CARGO POCKET TO ACCOMMODATE THIGH RIG

(75) Inventors: Francisco J. Morales, Modesto, CA (US); Cory Nykoluk, Oakdale, CA (US)

(73) Assignee: 5.11 Inc., Modesto, CA (US)

( * ) Notice: Subject to any disclaimer, the term of this patent is extended or adjusted under 35 U.S.C. 154(b) by 293 days.

(21) Appl. No.: 11/529,563

(22) Filed: Sep. 27, 2006

(65) Prior Publication Data

US 2010/0017943 A1 Jan. 28, 2010

(51) Int. Cl.
*A41D 27/20* (2006.01)

(52) U.S. Cl. ..... 2/247; 2/253; 224/661; 224/230

(58) Field of Classification Search ..... 2/2.5, 2/463, 79, 250, 247, 919, 77, 85, 94, 115, 2/227, 248, 252, 253, 254; 224/243, 192, 224/198

See application file for complete search history.

(56) References Cited

U.S. PATENT DOCUMENTS 2,038,331 A * 4/1936 Woolf ..... 2/253
2,097,975 A * 11/1937 Habegger ..... 2/247
2,663,876 A * 12/1953 Miller et al. ..... 2/227
2,694,810 A * 11/1954 Williamson ..... 2/79
5,072,456 A * 12/1991 Elin ..... 2/94
5,517,696 A * 5/1996 Krugler ..... 2/250
5,588,154 A * 12/1996 Blauer et al. ..... 2/69
5,687,896 A * 11/1997 Clift ..... 224/587
6,131,198 A * 10/2000 Westrick ..... 2/102
6,685,066 B2 2/2004 Cragg
7,058,987 B2 * 6/2006 Salazar ..... 2/247
2003/0205595 A1 * 11/2003 Young ..... 224/230
2005/0015844 A1 * 1/2005 Parsons ..... 2/94
2005/0017034 A1 * 1/2005 Ausanio ..... 224/230

* cited by examiner

*Primary Examiner*—Katherine Moran
*Assistant Examiner*—Richale L Quinn
(74) *Attorney, Agent, or Firm*—Thomas M. Freiburger

(57) ABSTRACT

A tactical pair of pants for police, military or other weapon-carrying personnel has a cargo pocket system that functions to store items in several pocket compartments in a normal cargo pocket configuration, or to carry a thigh rig holster for a pistol, in a dedicated position between cargo pocket compartments without blocking access to the pocket compartments.

19 Claims, 6 Drawing Sheets

PANTS WITH CARGO POCKET TO ACCOMMODATE THIGH RIG

BACKGROUND OF THE INVENTION

This invention is concerned with tactical clothing and gear for police, security personnel or other weapon-carrying persons. Specifically the invention relates to pants with cargo pockets providing space to accommodate a thigh rig holster without blocking access to pockets.

Thigh rigs are used by many police and other security or military personnel, to place a pistol at a convenient location for easy access. See, for example, U.S. Pat. No. 6,685,066 showing a thigh rig of one configuration. These thigh rigs, however, interfere with any cargo pockets that might be located at the outside of the thigh area of the pant leg, or prevent the inclusion of such pockets. Typically a pair of upper and lower straps extend from the holster portion or extending rigging of the thigh rig to encircle and engage around the thigh, over the outside of the pant leg. This eliminates valuable storage space for the wearer.

SUMMARY OF THE INVENTION

The invention provides a solution to this problem, with a novel cargo pocket system positioned at the outer side of the pant leg at the location where a thigh rig holster is to be located. In a preferred embodiment the cargo pocket system has a main pocket directly against the pant leg, to be used when no thigh rig is present. This top-opening pocket can hold large, generally flat items, for example, and may have a top closure flap. In addition to the large main pocket the system includes two outer or front cargo pockets that are connected to the outer surface of the main pocket. These outer cargo pockets are accessed by opening the flap of the main pocket, which normally would cover them, or the main pocket flap can be tucked into the main pocket so that the top openings of the cargo pockets are accessible. Additional closure straps with VELCRO or with snap fasteners can be provided individually for the outer or front pockets.

Some important features of this preferred configuration are that the front pockets, or outer pockets, are separated by a space within which can be positioned a thigh rig holster without blocking access to these front pockets, and that the front pockets are secured to the main pocket in such a way as to "float" over the main pocket, being connected near top and bottom and leaving a clearance space or slot between the back side of the front pocket and the outer panel of the main pocket. This clearance allows the base and straps of a thigh rig to be positioned behind the front pockets, so that, even with the main pocket no longer accessible, the two outer or front pockets are accessible for carrying various items.

The invention encompasses variations, including the elimination of the main pocket, with outer pockets connected to a fabric panel behind them (which could optimally be the fabric of the pants themselves). Also, whether or not a main pocket is included, one outer pocket, rather than two, can be provided.

Another preferred aspect of the invention is that the outer or front pockets, which are long and relatively narrow, vertically oriented, can have interior VELCRO patches so that each pocket can be used in its long state or in a shortened state.

It is among the objects to solve the problem of maintaining cargo pocket space in tactical pants which can receive a thigh rig holster for a weapon. These and other objects, advantages and features of the invention will be apparent from the following description of preferred embodiments, considered along with the accompanying drawings.

DESCRIPTION OF PREFERRED EMBODIMENTS

Figure 1:
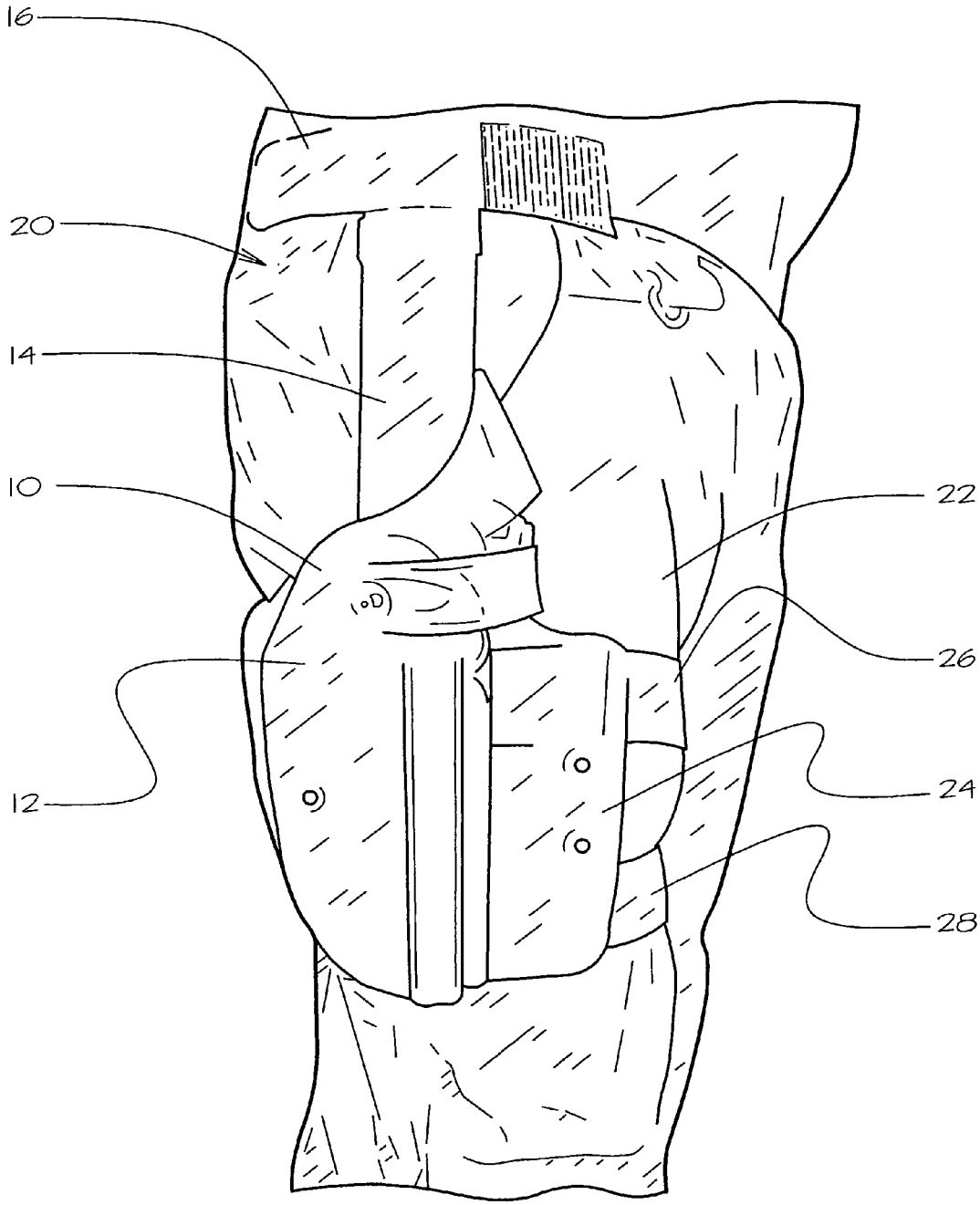
FIGURE 1 PRIOR ART
FIG. 1 is a perspective view showing a thigh rig holster retained on prior art tactical pants.

In FIG. 1 is shown a thigh rig 10 of typical conventional design, including a holster 12, a hanging strap 14 for hanging the rig from a belt 16 of a wearer 20, to position the rig 10 against the outside of the thigh 22 as shown, and webs or rigs 24 that extend in opposed directions from the holster 12 itself, as shown. The laterally extending webs or rigs 24 are secured to thigh straps 26 and 28 for extending around the thigh 22, with provision for cinching the straps as tightly as desired by the user for stability and security of the thigh rig.

Figure 2:
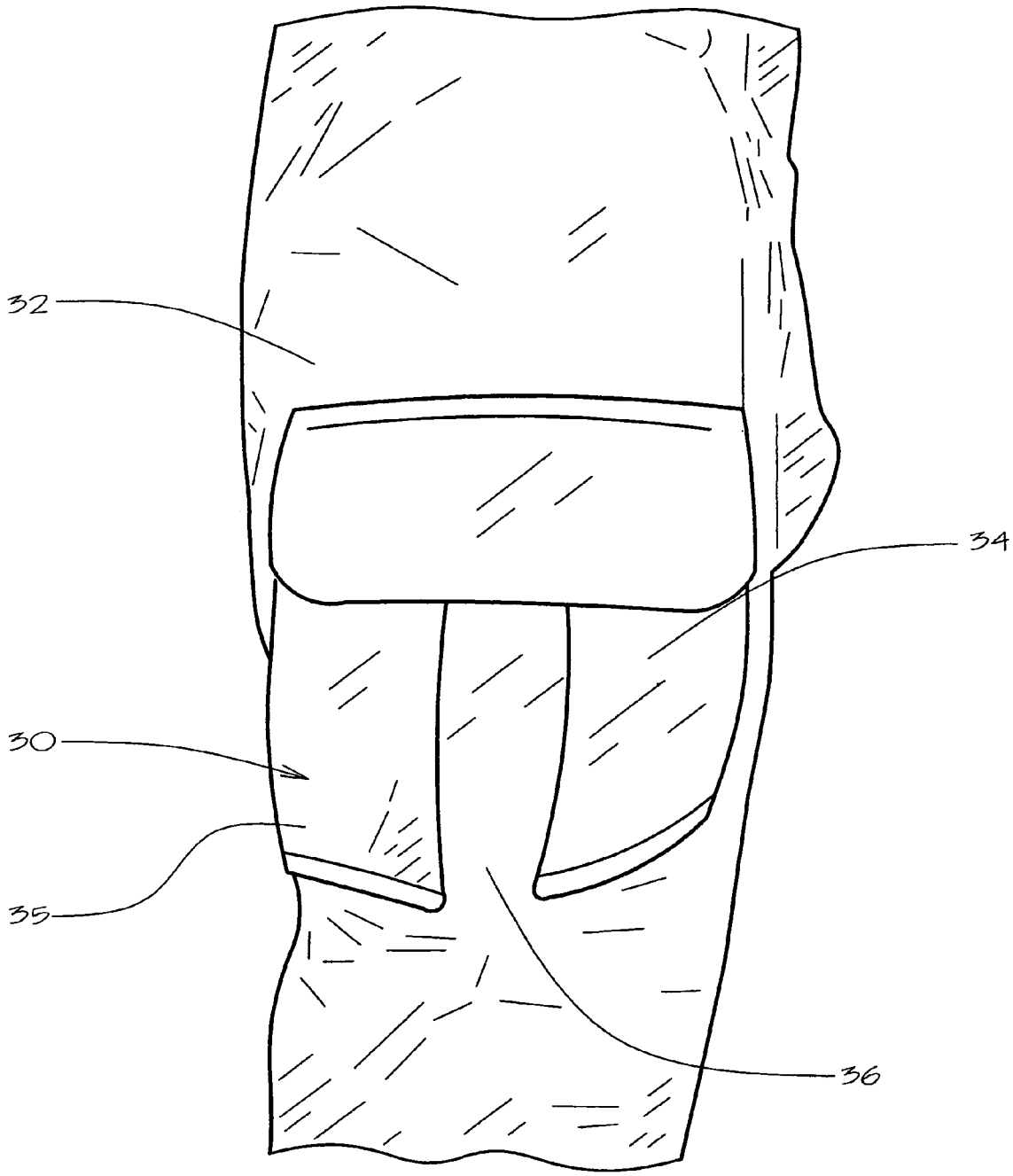
FIG. 2 is a perspective view, showing, from the side, a cargo pocket system of the invention on a pair of pants.

FIG. 2 shows, in a side view similar to FIG. 1, a tactical pocket system or cargo pocket system 30 according to the invention, on a pair of pants 32. The pocket system 30, in a preferred embodiment, include two front or outer pockets 34 and 35, with a space 36 between them. Preferably, the pocket system also includes a main pocket 38, over which the front pockets 34 and 35 "float", this main pocket not being seen in FIG. 2 but partially revealed in FIG. 3. The main pocket 38 can be closed by a cover flap 40 that also preferably covers both the outer pockets 34 and 35, which can be via VELCRO hook and loop fasteners indicated at 42 and 43 on the flap's underside and on the outer pocket 34, respectively. A top opening 44 of the main pocket is partially seen in FIG. 3.

Figure 3:
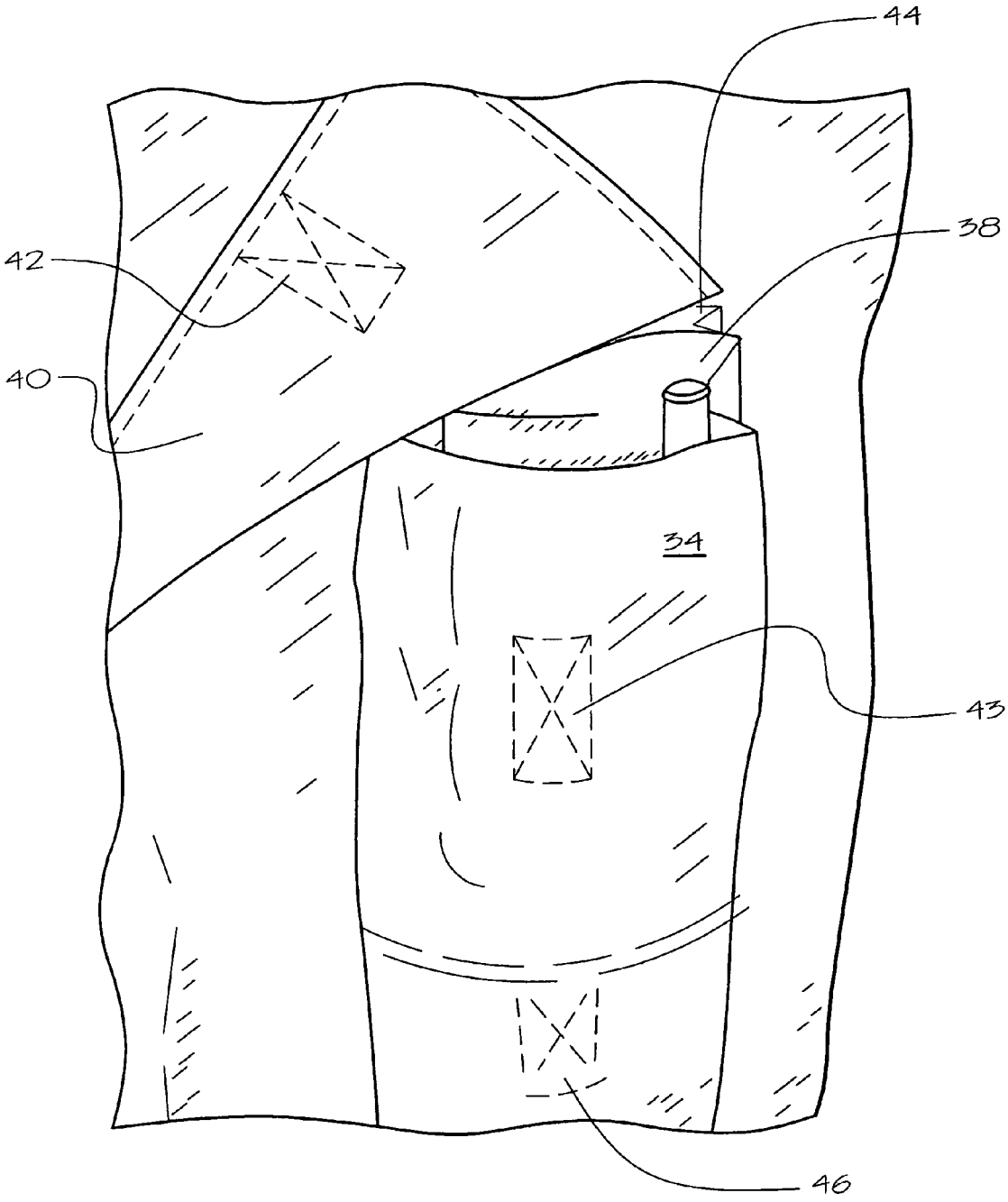
FIG. 3 is a perspective view showing a feature of the cargo pocket system of the invention.

The main pocket 38 can be used for storage of large and relatively flat articles, particularly those which are flexible and somewhat conformable against the thigh, such as papers, soft booklets, etc. The outer pockets or front pockets 34 and 35 can be used for holding portable telephones, radios, ammunition or other items of various shapes. As further explained below, the outer pockets in a preferred embodiment include a closure device 46 (which may be hook and loop fasteners, snaps or other easily releasable closure devices), for limiting the front pocket 34, 35 to a short mode, such as illustrated in FIG. 3, or for using the pocket in a long mode to retain longer items or simply to retain more volume of items. When a relatively small device such as a mobile telephone is stored, it is usually preferable to use the short mode as shown, to make the telephone (or a radio) more readily accessible.

Figure 4:
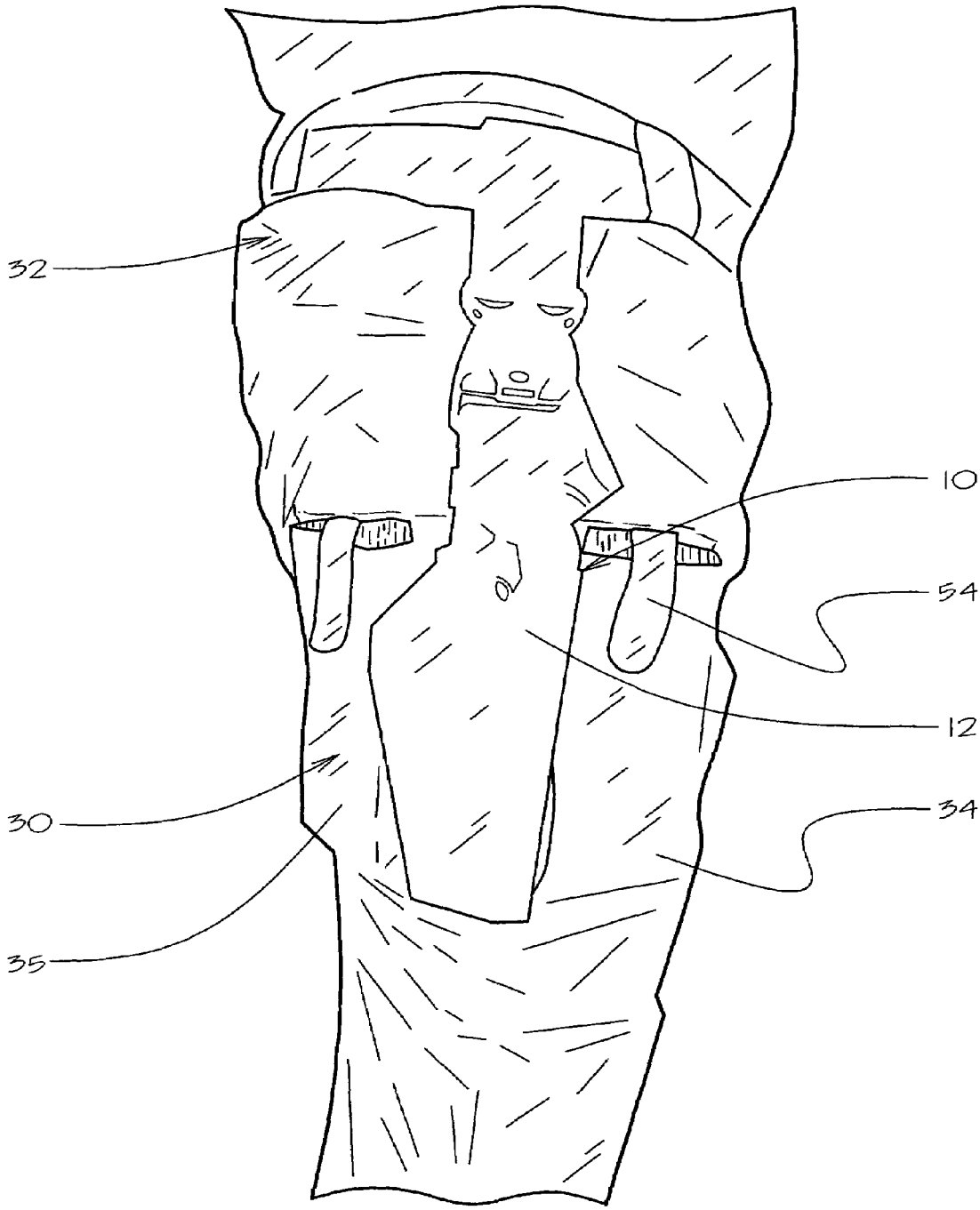
FIG. 4 is a perspective view showing a thigh rig holster being worn by a user, in connection with the cargo pocket system of the invention.

FIG. 4 shows the tactical or cargo pocket system 30 of the invention in use on the pants 32 in combination with a thigh rig 10 as shown in FIG. 1. The pocket system accommodates the thigh rig by positioning the holster 12 itself between the two front or outer pockets 34, 35. The holster lies against the space 36 defined between the two outer pockets 34, 35. In this way, access to the outer pockets still is possible and convenient. The thigh rig is situated such that the webs 24 or lateral rigging that extends from the holster portion 12, extend under and are covered by the outer pockets 34 and 35. As noted above, these pockets "float" over the main pocket to permit these webs of the rigging to slide under. The thigh straps 26 and 28, not seen in FIG. 4, extend from the ends of the thigh rigging and around the thigh. For this mode the cover flap 40 described above is tucked down into the main pocket 38, and thus is not seen in FIG. 4. The main pocket is not used in this mode for storing items that need to be accessible while the holster is worn.

In addition to accommodating a thigh rig holster at the appropriate location and height at the side of a wearer's pants, without covering or blocking access to pockets, the arrangement of the invention also helps secure the thigh rig in place. By closely retaining the webs or rigging at both sides of the holster between layers of fabric, the thigh rig holster is more securely held in place and in fact, users need not draw the thigh rig straps (26, 28 in FIG. 1) as tightly as would be the case when the thigh rig is worn in a conventional way as in FIG. 1. Moreover, the outer pockets 34 and 35 cover much of the rigging of the thigh rig and provide a cleaner and less obtrusive appearance, as can be seen from FIG. 4.

Figure 5:
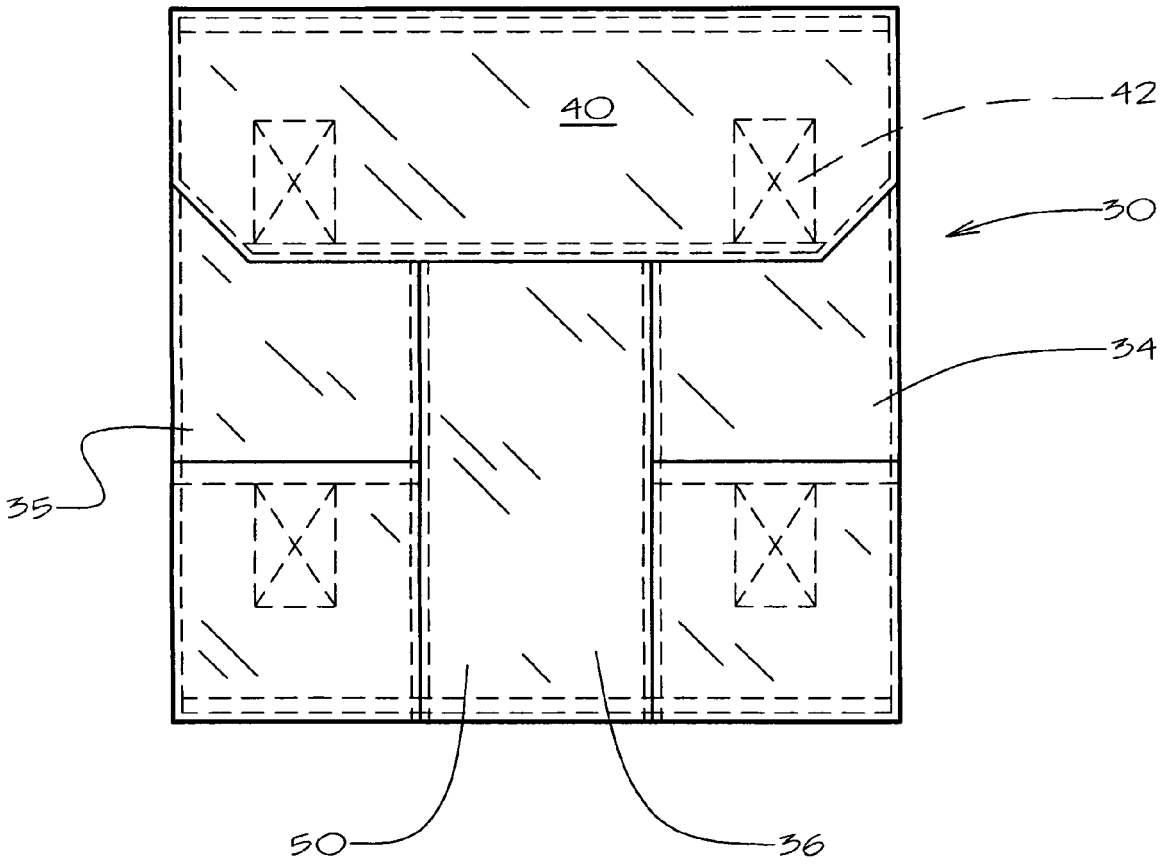
FIG. 5 is a flat view showing the pocket system of the invention.

FIG. 5 shows the pocket system 30 in flattened plan view. The stitching is indicated in dashed lines, for a preferred embodiment. The flap 40 is illustrated in the closed position, secured by VELCRO 42, thus closing both the main pocket and the outer or front pockets 34, 35. The main pocket includes an outer fabric panel 50 that serves as the outer surface of the main pocket, a portion of this panel 50 being visible at the space 36 between the two outer or front pockets 34, 35. This panel 50 serves as one side of the slots that receive the webs or rigging extensions of the thigh rig, the other side of each slot being formed by the back panel of the front pocket 34 or 35. The outer fabric panel 50 could even comprise the surface of the pants themselves, in an embodiment wherein the main pocket is not included. In that case, each outer or front pocket 34 or 35 is formed of front and back pieces of fabric material, and in the case of no main pocket, they can be stitched directly to the pants but in a way to define the slots for the thigh rigging as described above. Alternatively, the outer fabric panel 50 can be a discrete fabric piece that is connected to the outer pockets 34, 35. The cover flap 40 will ordinarily be eliminated if there is no main pocket, since it should be tucked out of the way when the thigh rig holster is present.

Figure 6:
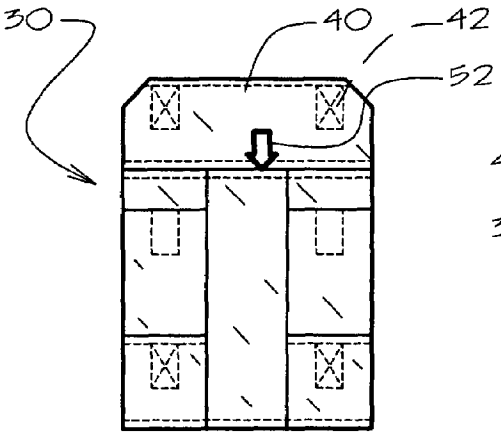
FIGS. 6, 7 and 8 are views similar to FIG. 5 and indicating use of the pocket system.
Figure 7:
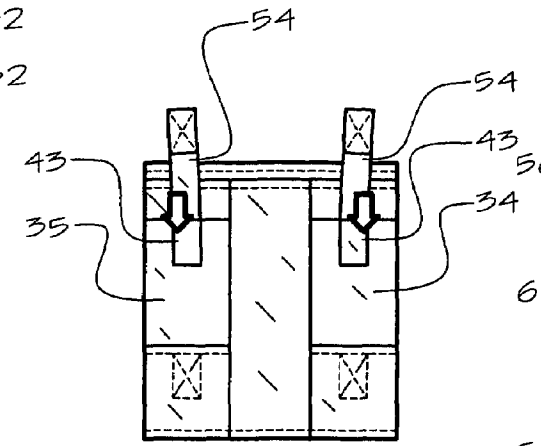
Figure 8:
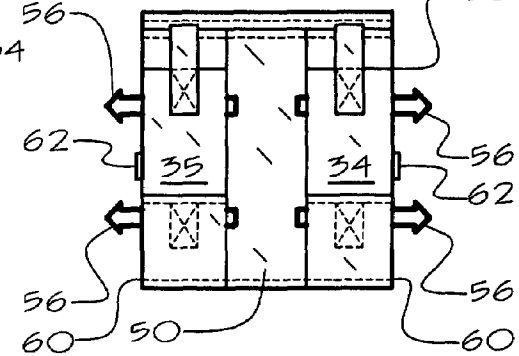

FIGS. 6 through 8 indicate use of the pocket system of the invention.

FIG. 6 shows the pocket system 30 with the cover flap 40 opened, and indicates tucking of the flap 40 into the main pocket, with the arrow 52. The pocket system is then in the configuration shown in FIG. 7, and FIG. 7 indicates that closure straps 54 can be provided for retaining items in the front pockets 34 and 35. These two straps, normally tucked down into the front pockets 34 and 35, can be deployed when needed in absence of the main pocket cover flap. As seen in the drawings, the closure straps 54 can connect to the same VELCRO patches 43, on the exterior of the front pockets, that are engaged by the VELCRO patches 42 on the main pocket cover flap when it is deployed. The main cover flap 40 closes all three pockets when the main pocket is available, and thus the separate closure straps 54 are not used in that case.

Figure 11:
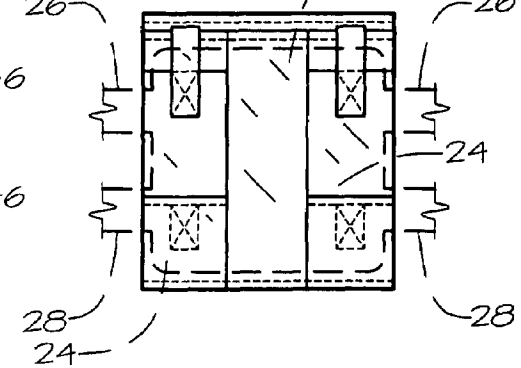

FIG. 8 indicates, with arrows 56, the threading of the holster straps 26 and 28 (see FIG. 1) through the slots between the front or outer pockets 34, 35 and the outer fabric panel 50. This pulls webs or rigging flanges 24, which are of relatively stiff plastic material, into these slots such that the holster resides in the position shown in FIG. 4. Note that the front or outer pockets 34 and 35 preferably are attached to the panel 50 beneath along stitch lines shown at 58 at the top and 60 at the bottom, leaving the space between these stitch lines open for the holster rigging. Additional attachment can be made via stitching indicated at 62 in FIG. 8, although this is not necessary. The attachment at 62 better holds the pockets 34 and 35 down against the outer fabric panel 50, especially when no holster is present, and these attachment points will lie between the upper and lower thigh straps 26 and 28 when the thigh rig holster is present. See FIG. 11 for a general indication of the position of the thigh rig holster 10 and rigging extensions 24, with the straps 26 and 28 extending out from the pocket system.

Figure 9:
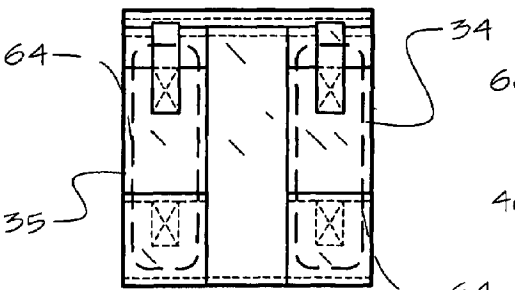
FIGS. 9, 10 and 11 are views similar to FIG. 6 but showing modes of use of the pocket system of the invention.
Figure 10:
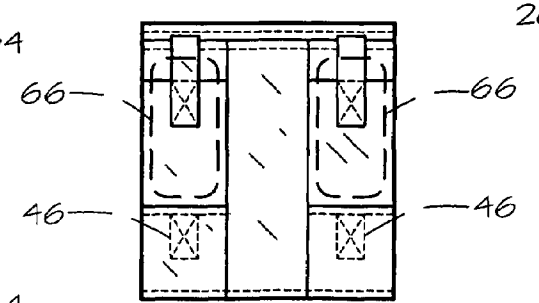

FIGS. 9 and 10 indicate use of the front or outer pockets 34 and 35, in the two different modes as noted above. In FIG. 9 these pockets are used in the long mode, with relatively long items 64 indicated in the pockets. In FIG. 10 the pockets are used in the short mode with VELCRO patches 46 secured together to limit the useable depth of each pocket; shorter items 66 are indicated in the pockets. Clearly the two pockets could be used in different modes at any given time. Note also that the long and short modes are useful whether or not the main pocket is available or is included in the pocket system.

The invention also encompasses the use of only one front or outer pocket 34 or 35. The principal feature of the invention is to allow the use of thigh rig holster while still preserving cargo pocket space on the thigh of the user's pants, at generally the same level as the holster will be located, by providing an open slot behind the pocket, so that a portion of the thigh rig can extend through the resulting slot. Preferably two outer pockets and a main pocket are included but as noted above, it is possible to eliminate the main pocket, and only a single pocket could be included (whether or not the main pocket is provided), so long as a space is provided adjacent to that pocket for the holster and a slot is provided behind the pocket for sliding in of the rigging extension. The outer fabric panel, sometimes referred to simply as a fabric panel, on which the outer pocket(s) are secured, may be simply a piece of fabric if the main pocket is not included; it may even be the fabric of the pants themselves, eliminating the extra layer, if desired.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. Pants for weapon-carrying personnel, with cargo pockets arranged to accommodate a thigh rig holster, comprising:

a main pocket attached to an outside thigh area on one leg of the pants, the main pocket having an outer fabric panel defining an outer wall of the pocket, and the pocket being capable of receiving relatively large, generally flat items, at least one front pocket secured on an outer side of the main pocket's outer fabric panel, narrower in width than the main pocket and covering a portion of the main pocket's outer fabric panel but leaving a laterally adjacent space uncovered on the outer fabric panel, the space being wide enough for a thigh rig holster to lie against the outer fabric panel at said space, laterally adjacent to the front pocket, without blocking access to the top of the front pocket, and the front pocket being secured to the outer fabric panel of the main pocket at securement positions near top and bottom ends of the front pocket and with the securement positions leaving unobstructed pass-through clearance between the front pocket and said outer fabric panel sufficient to allow at least one generally horizontal strap of a thigh rig holster to slide horizontally through the clearance to be positioned in engagement around the pants leg with the holster positioned at said space and adjacent to the front pocket.

2. Pants according to claim 1, wherein the main pocket has a top opening and includes a cover flap positioned to extend over and cover the opening of the main pocket, the cover flap being capable of tucking into the main pocket when a thigh rig holster is to be attached.

3. Pants according to claim 2, wherein the cover flap, and an exterior surface of the front pocket, have cooperating hook and loop fasteners for closure.

4. Pants according to claim 2, wherein the front pocket has a top opening and includes a closure strap capable of a first mode in which it is tucked into the front pocket and of a second mode in which it is used over the top opening of the front pocket to retain articles therein.

5. Pants according to claim 4, wherein the front pocket's closure strap, and the outside surface of the front pocket, have hook and loop fasteners for closure.

6. Pants according to claim 1, including two said front pockets, the two front pockets both being secured on the outer side of the main pocket's outer fabric panel and being spaced apart such that said uncovered space on the outer fabric panel lies between the two front pockets.

7. Pants according to claim 1, wherein the front pocket includes internal hook and loop fasteners at a selected level inside the pocket, such that the hook and loop fasteners can be connected to limit the front pocket to a shorter depth when desired, and such that the hook and loop fasteners can be opened to use the full depth of the front pocket when desired.

8. Pants according to claim 1, wherein the front pocket is secured to the outer fabric panel of the main pocket along stitching lines essentially at the top and bottom of the front pocket.

9. A cargo pocket system for pants intended for weapon-carrying personnel, to accommodate a thigh rig holster, comprising:

a fabric panel, at least one front pocket secured on the fabric panel, covering a portion of the fabric panel but leaving a laterally adjacent space uncovered on the fabric panel, the space being wide enough for a thigh rig holster to lie against the fabric panel at said space, laterally adjacent to the front pocket, without blocking access to the top of the front pocket, and the front pocket being secured to the fabric panel at securement positions near top and bottom ends of the front pocket and the securement positions leaving unobstructed pass-through clearance between the front pocket and the fabric panel sufficient to allow at least one generally horizontal strap of a thigh rig holster to slide horizontally through the clearance to be positioned in engagement around the pants leg with the holster positioned at said space and adjacent to the front pocket.

10. A cargo pocket system according to claim 9, including two said front pockets, the two front pockets both being secured on the fabric panel and being spaced apart such that said uncovered space on the outer fabric panel lies between the two front pockets.

11. A cargo pocket system according to claim 9, wherein the front pocket includes internal hook and loop fasteners at a selected level inside the pocket, such that the hook and loop fasteners can be connected to limit the front pocket to a shorter depth when desired, and such that the hook and loop fasteners can be opened to use the full depth of the front pocket when desired.

12. Pants for weapon-carrying personnel, with a cargo pocket system arranged to accommodate a thigh rig holster, comprising:

an outer fabric panel on a thigh area of a leg of the pants, at least one front pocket secured onto the outer fabric panel, and covering a portion of the outer fabric panel but leaving a laterally adjacent space uncovered on the outer fabric panel, the space being wide enough for a thigh rig holster to lie against the outer fabric panel at said space, laterally adjacent to the front pocket, without blocking access to the top of the front pocket, and the front pocket being secured to the outer fabric panel of at securement positions near top and bottom ends of the front pocket and with the securement positions leaving unobstructed pass-through clearance between the front pocket and said outer fabric panel sufficient to allow at least one generally horizontal strap of a thigh rig holster to slide horizontally through the clearance to be positioned in engagement around the pants leg with the holster positioned at said space and adjacent to the front pocket.

13. Pants according to claim 12, wherein the outer fabric panel comprises a part of the pants leg.

14. Pants according to claim 12, including a main pocket wider than the front pocket and said outer fabric panel comprising an outer wall of the main pocket.

15. Pants according to claim 12, including two said front pockets, both attached to the outer fabric panel with said space between the two front pockets.

16. A method for wearing a thigh rig while preserving access to cargo pockets on the outer side of the thigh on a pair of pants, comprising:

the user's wearing a pair of cargo pants having, at the side of the thigh of a pants leg, at least one outer pocket secured to the pants in such a way as to leave a pass-through clearance behind the outer pocket to allow a portion of a thigh rig to slide through the clearance, and attaching a thigh rig to the pants leg, including installation of straps around the pants leg, and including extending straps of the thigh rig through the pass-through clearance back of the outer pocket such that a portion of the thigh rig extends to a position back of the outer pocket and a holster of the thigh rig lies laterally adjacent to the outer pocket, then securing the straps around the thigh, thereby providing convenient access to both the holster and the outer pocket.

17. The method of claim 16, wherein the pants include two outer pockets laterally spaced apart, with a space between the two pockets against which the holster of the thigh rig is placed, both pockets having said pass-through clearance back of the pockets and the thigh rig having portions extending into the clearances behind both pockets, providing increased stability of the thigh rig on the pants.

18. The method of claim 16, wherein the pants include a main pocket, covering a larger area of the pants leg than the outer pocket, the main pocket including an outer fabric panel and the outer pocket being secured to the outer fabric panel, providing said clearance between the outer pocket and the outer fabric panel.

19. The method of claim 18, further including a cover flap to cover the open top of the main pocket while also covering the open top of the outer pocket, and the method including, prior to installing the thigh rig, tucking the cover flap down into the main pocket.

* * * * *